United States Patent [19]

Palencher

[11] 3,993,104

[45] Nov. 23, 1976

[54] SHUTTLE POSITIONER AND NIPPER OPENING DEVICE FOR LOOM

[75] Inventor: Jacques Palencher, Troyes, France

[73] Assignee: LeBocey Industries, Troyes, France

[22] Filed: Sept. 15, 1975

[21] Appl. No.: 613,064

[30] Foreign Application Priority Data

Sept. 25, 1974 France ..... 74.32340

[52] U.S. Cl. ..... 139/155; 139/438

[51] Int. Cl.[2] ..... D03D 49/48; D03D 47/24

[58] Field of Search ..... 139/155, 252, 125, 126, 139/241, 437, 438, 439

[56] References Cited

UNITED STATES PATENTS

| | | | |
|---|---|---|---|
| 758,895 | 5/1904 | Brink et al. | 139/155 X |
| 960,019 | 5/1910 | Hunt | 139/155 X |
| 1,410,518 | 3/1922 | Smith | 139/155 X |
| 3,429,344 | 2/1969 | Svaty et al. | 139/155 X |
| 3,543,809 | 12/1970 | Laval | 139/438 |
| 3,837,367 | 9/1974 | Laval | 139/155 |
| 3,838,714 | 10/1974 | Palencher | 139/155 |
| 3,895,657 | 7/1975 | Bilek | 139/155 X |

*Primary Examiner*—James Kee Chi

*Attorney, Agent, or Firm*—Kinzer, Plyer, Dorn & McEachran

[57] ABSTRACT

The present invention relates to a weft pass loom comprising on the batten a shuttle provided with end grips for the weft threads as well as on the frame with devices for the correction of the shuttle position and for the opening of the shuttle grips, characterized in that it comprises, fixed to each of the sides of the frame, independent devices for correcting the position of the shuttle and for opening the grips, whereby each of these devices is provided with a regulating means.

10 Claims, 5 Drawing Figures

FIG.1
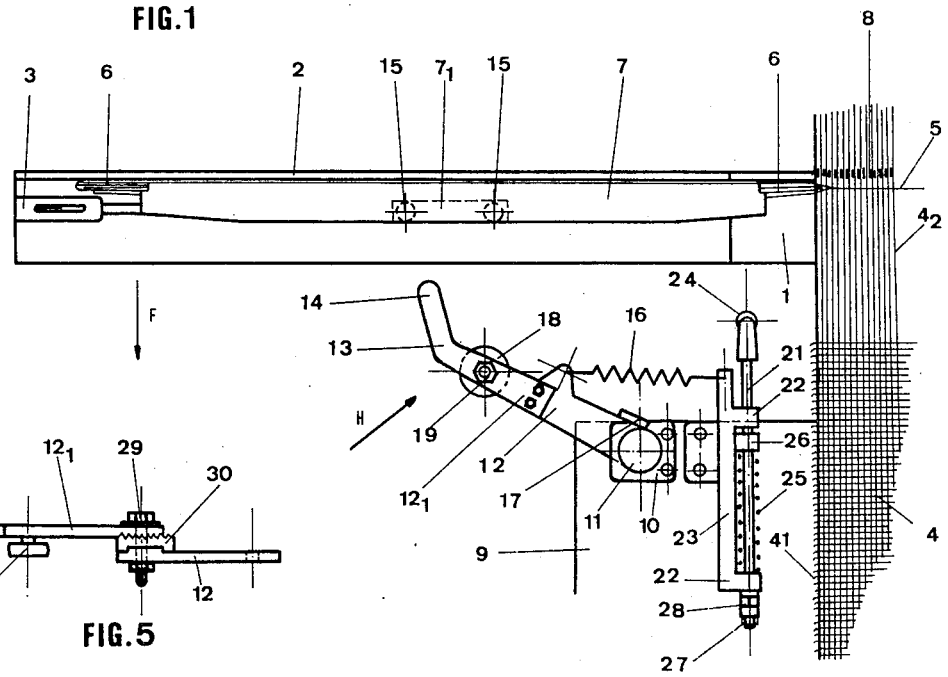
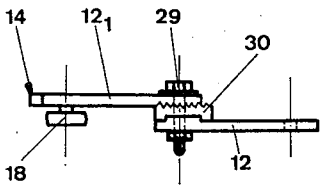
FIG.5
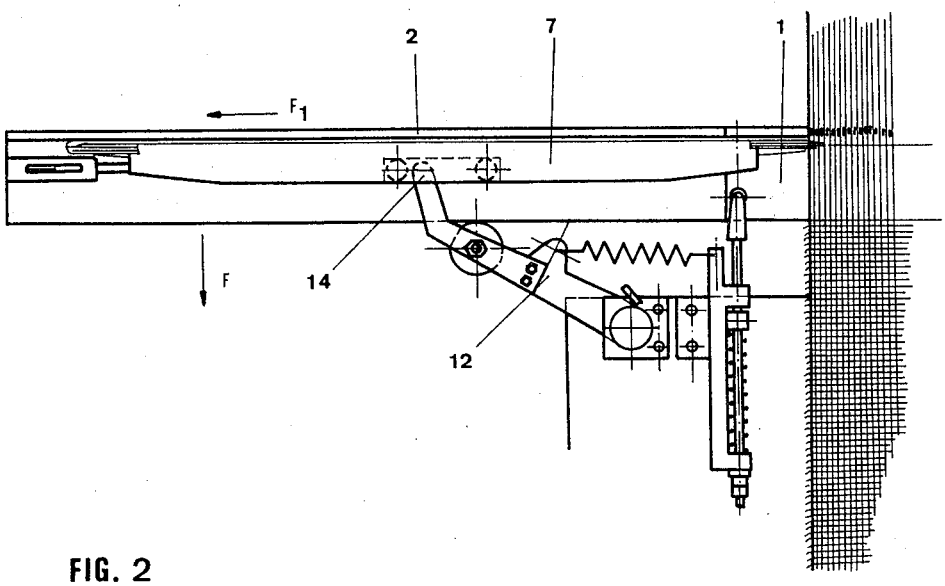
FIG. 2

SHUTTLE POSITIONER AND NIPPER OPENING DEVICE FOR LOOM

The present invention relates to a weft pass loom.

As is known in weft pass looms the shuttle has at its ends grips wherein are alternatively gripped the weft threads in order to pass them through the shed.

These looms also have, in known manner, weft thread cutting devices which serve to cut the weft thread which has been thrown through the shed and which is still connected to the supply bobbin and to grip the cut end of this thread which is connected to the supply bobbin so that, during the next operating cycle, the shuttle grips can seize the gripped thread and form a new weft.

These known looms also have devices which ensure on the one hand the correction of the shuttle position in the shuttle box and on the other the opening of the shuttle grips.

However, these grip opening and correction devices comprise simultaneously controlled, interconnected members so that with these known looms it is not possible to perform adequate adjustments ensuring that at all times the shuttle occupies a correct position before the opening of the grip in question is commenced. This applies no matter what the exact length of the shuttle, the size of the thread used, the opening resistance of the grip or the operating speed of the loom.

The present invention more particularly has for its object the elimination of the above disadvantages and to this end relates to a weft pass loom comprising on the batten a shuttle provided with end grips for the weft threads as well as on the frame with devices for the correction of the shuttle position and for the opening of the shuttle grips, characterised in that fixed to the sides of the frames it has independent devices for the correction of the shuttle position and for opening the grips, whereby each of these devices is provided with a regulating means.

According to another characteristic of the invention the correction devices comprise a lever pivoting on the loom frame and cooperating by its end with the shuttle, whilst the opening device comprises a rod cooperating by its end with the shuttle grip, whereby for its opening this rod elastically slides in a support fixed to the frame and positioned perpendicular to the pivot axis of the lever.

According to another characteristic of the invention the shuttle position correction lever comprises a roller whose position is fixed on a regulatable lever, whereby the said roller cooperates with the loom batten.

Figure 3:
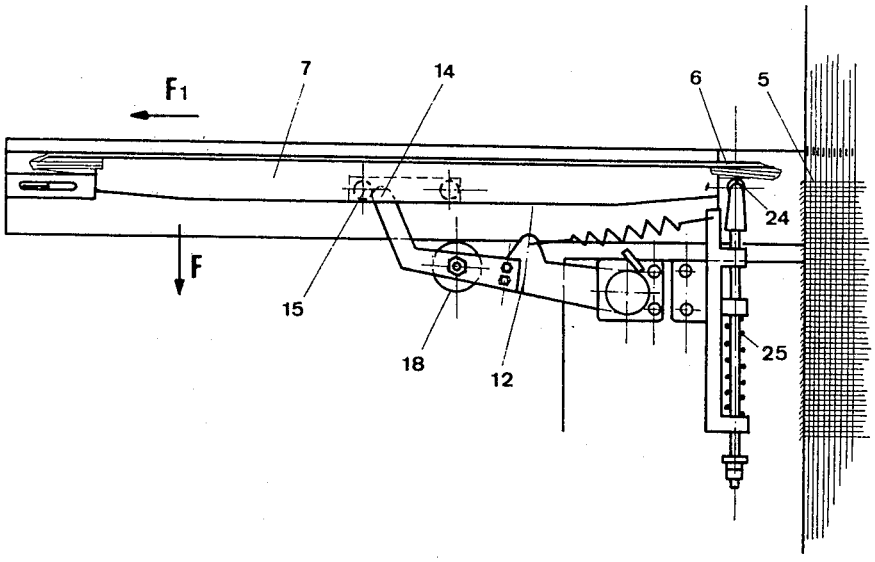
Figure 4:
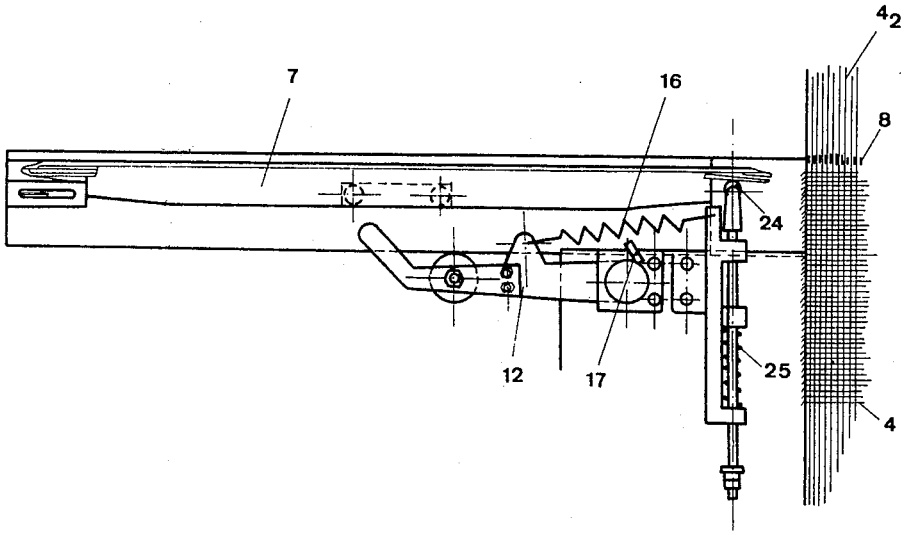

An embodiment of the invention is shown in non-limitative manner in the attached drawings, wherein show:

FIG. 1 a partial plan view of one side of the loom according to the invention at the start of the beating-up movement of the batten;

FIG. 2 a view corresponding to FIG. 1 during the correction of the shuttle position;

FIG. 3 the same loom at the end of correcting the shuttle position and during the opening of the grip;

FIG. 4 the loom at the end of the beating-up movement;

FIG. 5 a view in the direction of H of the shuttle position correction lever.

The attached drawings show the loom batten 1, provided with the shuttle box 2 and the picker stick 3.

In the drawings the reference numeral 4 designates woven material during manufacture, whilst $4_1$ designates the cut ends of the weft threads already introduced into the material, whilst $4_2$ designates the warp threads determining the shed, through which has been thrown the weft thread 5 still attached to the grip 6 of the loom shuttle 7.

On batten 1 are also schematically shown the dents 8 of the reed.

The loom according to the invention comprises a shuttle position correction device and a device for opening the grips of the said shuttle, whereby these two devices are independent and have regulating means making it possible to ensure a correct operation of the loom whatever the shuttle length and whatever the resistance to opening of the shuttle grips, the possible correction movement range being relatively large.

The loom according to the invention makes it possible to ensure that at a precise moment during the operation cycle the shuttle is placed in a correct position to enable the correct opening of the shuttle grip. As this grip opening also takes place at a precise moment during the operating cycle and therefore with the batten in a precise position this grip opening time can be accurately regulated just before the end of the passage movement through the batten of the just thrown weft thread.

Thus, according to the invention, frame 9 has a cover 10 on which is mounted in pivotable manner a shaft 11 of a lever 12 having an elbow at 13 and whose end 14 is locatable in a recess $7_1$ formed in shuttle 7. The said recess has at its end rollers 15, with one of which cooperates the end 14 of lever 12 during each shuttle position correction.

To lever 12 is also attached a restoring spring 16 which continually attempts to apply lever 12 against a stop member 17 formed on cover 10. The actuation of this lever is obtained from batten 1 during the beating-up movement in the direction of arrow F and via a roller 18.

In the represented embodiment roller 18 is mounted in rotary manner on a shaft 19, which is itself located in an extension $12_1$ of the arm of lever 12.

Extension $12_1$ is fixed in regulatable manner on lever 12 via screws 29 which successively pass through elongated openings formed in extension $12_1$, then through an intermediate member 30 and finally through lever 12. To permit a precise regulation of the position of extension $12_1$ and therefore of the end 14 and roller 18, the facing surfaces of extension $12_1$ and of the intermediate member 30 are provided with small complimentary grooves. Moreover, the intermediate member 30 is positioned on lever 12 by means of a mortise and tenon joint.

The opening device for grips 6 of the shuttle comprises a rod 21 mounted slidingly at 22 in a support 23 which is also fixed to the loom frame. At one of its ends rod 21 is provided with an actuation stop 24, preferably in the form of a roller, whilst a spring 25 is positioned around the said rod 21 between a stop 26 of the said rod and one of the bearings 22 of support 23. Spring 25 has the tendency to constantly push end 24 of the rod towards batten 1 and the opposite end 27 of rod 21 is provided with a thread and nuts 28 permitting the regulation of the active length of rod 21 and therefore the precise position of roller 24 when the latter is still not in contact with one of the shuttle grips.

Thus, the possibilities of regulating roller 24 and lever $12_1$ make it possible to accurately regulate the end of the correction movement of shuttle 7 relative to the start of opening of the grip in question and also relative to the end of the beating-up movement, so that these operations are performed at the correct time and position during the loom operating cycle. Thus, FIG. 2 shows the loom whilst batten 1 is performing its beating-up movement. Furthermore, in FIG. 2 end 14 of extension $12_1$, which is inclined relative to batten 1, pushes shuttle 7 into shuttle box 2 until the said end 14 of extension $12_1$ escapes from roller 15 (FIG. 3). It should be noted that during this shuttle position correction batten 1 exerts a thrust on lever 12-12$_1$ in the direction of arrow F, but that lever 12-12$_1$ only exerts a thrust in the direction of arrow $F_1$ on the shuttle, i.e. parallel to the length of the batten. Thus, the shuttle position correction operation causes no increase of the friction of the shuttle on the batten, which reduced the danger of wear.

It should also be noted (FIG. 3) that when the end 14 of extension $12_1$ terminates the correction of the shuttle position grip 6 has come into contact with roller 24 and, during the batten movement, spring 25 is compressed whilst grip 6 is open so as to release the weft thread 5 which has just been thrown through the shed.

Finally (FIG. 4) the beating-up movement of the batten comes to an end and the dents of reed 8 beat up the weft thread 5 on the already made cloth.

During the return of the batten to the rear position spring 16 draws back lever 12-12$_1$ against stop 17, whilst spring 25 brings roller 24 into its forward rest position.

Obviously the invention is not limited to the embodiment described and presented hereinbefore and numerous variants thereof are possible without passing beyond the scope of the invention.

I claim:

1. A woof-gauge weaving loom comprising, on the batten thereof, a shuttle provided with end nippers for the woof threads, and, on the chassis thereof being provided with devices for both correcting the position of the shuttle and for opening the nippers on the shuttle, each of said correction devices comprising an adjustable lever pivotable on the chassis of the loom and having a portion engageable with a guide element on the shuttle, and said nipper opening devices each comprising a rod coacting, by one end, with the nipper of the shuttle for its opening, said rod sliding elastically in a support fixed to the chassis and being arranged perpendicularly to the pivoting axis of the lever.

2. Loom according to claim 1 in which a roller, engageable with the batten during beating-up movement of the batten, is supported on said lever.

3. Loom according to claim 2 in which the lever is constructed of two separable parts, one part being adjustable for precise regulation of the portion which engages said guide element.

4. Loom according to claim 1 in which each nipper opening device is longitudinally adjustable.

5. Loom according to claim 4 in which the lever is constructed of two separable parts, one part being adjustable for precise regulation of the portion which engages said guide element.

6. Loom, according to claim 1 characterised in that the lever cooperates with a stop and a return spring, the said stop being positioned in such a way that in the rest position the lever is kept inclined relative to the batten by the spring.

7. Loom, according to claim 6, characterised in that the lever is elbowed and cooperates by its one end with a slot formed in the shuttle.

8. Loom, according to claim 7, characterised in that said one end of the lever cooperates with at least one roller mounted in rotary manner on the shuttle.

9. Loom according to claim 8 in which the lever is constructed of two separable parts, one part being adjustable for precise regulation of the portion which engages said guide element.

10. Loom according to claim 9 in which each nipper opening device is longitudinally adjustable.

* * * * *